US007134570B1

(12) United States Patent
Heath et al.

(10) Patent No.: US 7,134,570 B1
(45) Date of Patent: Nov. 14, 2006

(54) SMOOTH SPOUTED DISPOSABLE LID FOR A CUP

(76) Inventors: Robert C. Heath, 4405 W. Oakland St., Broken Arrow, OK (US) 74012; Jett E. Stubbs, 7840 S. Hickory Ct., Broken Arrow, OK (US) 74011

( * ) Notice: Subject to any disclaimer, the term of this patent is extended or adjusted under 35 U.S.C. 154(b) by 488 days.

(21) Appl. No.: 09/491,094

(22) Filed: Jan. 24, 2000

(51) Int. Cl.
*A47G 19/22* (2006.01)
*B65D 43/08* (2006.01)

(52) U.S. Cl. ..... 220/717; 220/711; 220/796; 220/802

(58) Field of Classification Search ..... 220/780, 220/784, 787, 789, 790, 796, 801, 703, 705, 220/711, 717, 716, 713, 712, 800, 802, 786, 220/792; 215/387; 222/570, 569
See application file for complete search history.

(56) References Cited

U.S. PATENT DOCUMENTS

| | | | | | |
|---|---|---|---|---|---|
| 516,354 | A | * | 3/1894 | MacMorris | 220/717 |
| 2,317,046 | A | * | 4/1943 | Fleming | 215/387 X |
| 3,065,875 | A | * | 11/1962 | Negoro | 220/784 |
| 3,309,000 | A | * | 3/1967 | Haverstick | 222/570 X |
| 3,352,448 | A | * | 11/1967 | Livingstone | 220/790 X |
| 3,429,478 | A | * | 2/1969 | Ward | 220/717 |
| 3,583,596 | A | * | 6/1971 | Brewer | 220/784 X |
| 3,739,938 | A | * | 6/1973 | Paz | |
| 4,026,459 | A | * | 5/1977 | Blanchard | 220/287 X |
| 4,083,466 | A | * | 4/1978 | McManaway | 222/570 X |
| 4,243,156 | A | * | 1/1981 | Lobbestael | 220/717 X |
| 4,333,583 | A | * | 6/1982 | Montemarano | |
| 4,345,695 | A | * | 8/1982 | Galloway et al. | |
| 4,353,489 | A | * | 10/1982 | Arnold et al. | 222/570 |
| 4,388,996 | A | * | 6/1983 | Panicci | |
| 4,428,498 | A | | 1/1984 | Obey | |
| 4,478,346 | A | * | 10/1984 | Spong | 220/711 |
| 4,508,235 | A | * | 4/1985 | Steele et al. | 220/784 X |
| 4,574,970 | A | * | 3/1986 | Schwarz | 220/713 |
| 4,589,569 | A | * | 5/1986 | Clements | 220/713 X |
| 4,756,440 | A | | 7/1988 | Gartner | |
| 4,782,975 | A | * | 11/1988 | Coy | |
| 4,796,774 | A | * | 1/1989 | Nabinger | |
| 4,801,027 | A | * | 1/1989 | Hunter | 220/711 X |

(Continued)

FOREIGN PATENT DOCUMENTS

| | | | | |
|---|---|---|---|---|
| DE | 2137184 | * | 2/1973 | 220/713 |

(Continued)

*Primary Examiner*—Robin A. Hylton
(74) *Attorney, Agent, or Firm*—Frank J. Catalano

(57) ABSTRACT

A disposable lid for a cup has an annular clamp which is adapted to be seated on the rim of the cup and to grip the interior and exterior walls of the lip of the cup so as to firmly fix the lid to the cup and a frustoconical spout which extends upwardly from the rim to a liquid discharge port at the apex of the spout, the spout having a truncation in the shape of a horizontal plane tangent to the bottom wall of a horizontal cylinder and a base of inside diameter equal to the top inside diameter of the clamp so as to permit an unobstructed, non-turbulent flow of liquid from the cup to the discharge port. Preferably, the clamp has a circular rim with inner and outer edges and a bottom face adapted to be seated on a rim of the cup and an inner inverted frustoconical serrated lip extending downwardly from the inner edge and an outer frustoconical nodulous lip extending downwardly from the outer edge which cooperate to grip the lip of the cup therebetween.

9 Claims, 3 Drawing Sheets

U.S. PATENT DOCUMENTS 4,810,245 A * 3/1989 Aagesen
4,828,141 A * 5/1989 Coy
4,836,404 A * 6/1989 Coy
4,899,902 A * 2/1990 DeMars
4,946,062 A * 8/1990 Coy
4,953,737 A * 9/1990 Meyers ..... 220/717 X
4,961,510 A * 10/1990 Dvoracek ..... 220/713
5,050,758 A * 9/1991 Freeman et al. ..... 222/570 X
5,050,759 A * 9/1991 Marble ..... 220/705
5,079,013 A * 1/1992 Belanger
5,147,066 A 9/1992 Snider
5,186,347 A * 2/1993 Freeman et al. ..... 222/570 X
5,224,634 A * 7/1993 Graham ..... 222/570 X
5,253,781 A * 10/1993 Van Melle et al.
5,335,812 A * 8/1994 Boller ..... 220/709
5,366,109 A 11/1994 Prosham
5,397,023 A * 3/1995 Toczek et al. ..... 220/709
5,433,338 A * 7/1995 Proshan ..... 220/717
5,542,670 A * 8/1996 Morano ..... 220/717 X
5,624,053 A * 4/1997 Freek et al. ..... 220/713
5,645,191 A * 7/1997 Neville ..... 220/717
5,706,973 A * 1/1998 Robbins, III et al.
D397,906 S 9/1998 Briggs et al.
5,839,581 A 11/1998 Vagedes
5,871,118 A * 2/1999 Franzese ..... 220/717
D407,269 S 3/1999 Fletcher
5,890,620 A * 4/1999 Belcastro ..... 220/717 X
5,890,621 A 4/1999 Bachman et al.
5,894,952 A * 4/1999 Mendenhall et al. ... 220/717 X
5,988,425 A * 11/1999 Yehl et al. ..... 220/717 X
6,047,852 A * 4/2000 Evans et al. ..... 220/713 X
6,050,445 A * 4/2000 Manganiello ..... 220/717 X
6,056,144 A * 5/2000 Strange et al. ..... 220/784 X
6,062,419 A * 5/2000 Kruger et al. ..... 220/711
6,102,245 A * 8/2000 Haberman ..... 220/717 X
6,112,926 A * 9/2000 Fishman ..... 220/717 X

FOREIGN PATENT DOCUMENTS

EP 244379 * 11/1987 ..... 222/570
GB 2251842 * 7/1992 ..... 222/570

* cited by examiner

SMOOTH SPOUTED DISPOSABLE LID FOR A CUP

BACKGROUND OF THE INVENTION

This invention relates generally to disposable containers and more particularly concerns disposable lids for cups.

There are many variations of disposable lids for cups for hot and cold beverages. Many are designed for use with a straw and do not permit drinking directly through an opening in the lid. All of them, whether used with or without a straw, are attached to a cup by an outer rim that clamps around the outside wall of the lip of the cup. Some, in order to provide additional rigidity to the lid, have a slightly depressed inner portion which fits within the rim of the cup and, in some cases, may abut the upper portion of the cup on its inner wall. However, the lip of the cup is not clamped between the outer rim and the inner depression. This becomes all too apparent when, as the cup is slightly squeezed during use, the lid pops off. Moreover, those lids having the depression above described generally extend horizontally from the bottom of the depression toward the center of the cup so as to obstruct or cause turbulence in the flow of liquid from the cup across the depression. As for lids designed for drinking directly through a discharge port in the lid, the upper portion is substantially flat or at best at a modest angle approximating ten degrees so that the user's nose strikes the top of the lid as the contents are consumed. A significant rearward tilting of the head is required if the contents of the cup are to be fully consumed. Anyone who has attempted this feat while driving a motor vehicle can attest to the difficulties experienced in observing the highway as the last drop of coffee is drained from the container.

Considering the above scenarios, obstructed or turbulent flow, inadvertent disengagement of the lid from the cup and excessive tilting of the head in emptying the cup contents are major contributors to inconvenience, frustration and spills in the use of cups with disposable lids. These problems are especially exacerbated for young children learning to drink from a cup. For convenience and for sanitary reasons, the use of disposable training cups and lids for children is highly desirable, but no disposable lids suitable for such purpose are available.

It is, therefore, an object of this invention to provide a disposable lid for a cup which firmly grips the inside and outside walls of the lip of the cup. Another object of this invention is to provide a disposable lid for a cup which seats firmly on the rim of the cup. A further object of this invention is to provide a disposable lid for a cup which permits unobstructed flow of liquid from the cup to the discharge port. Yet another object of this invention is to provide a disposable lid for a cup which permits non-turbulent flow of liquid from the cup to the discharge port. It is also an object of this invention to provide a disposable lid for a cup which facilitates unobstructed and non-turbulent flow of liquid to its discharge port from all directions. Still another object of this invention is to provide a disposable lid for a cup which is contoured for comfortable insertion into the mouth of the user. An additional object of this invention is to provide a disposable lid for a cup which is contoured for comfortable use by young children.

SUMMARY OF THE INVENTION

In accordance with the invention, a disposable lid for a cup has an annular clamp adapted to be seated on the rim of the cup and to grip the interior and exterior walls of the lip of the cup so as to firmly fix the lid in place on the cup. A spout extends upwardly from the rim to a liquid discharge port at the apex of the spout. The inner wall of the clamp and the inner wall of the spout converge smoothly to the discharge port so as to permit unobstructed, non-turbulent flow of liquid from the cup to the spout discharge port. The preferred discharge port is approximately an elongated rectangle or ellipse so as to conform to a narrow passage formed by the lips of the user. The preferred spout is frustoconical with a truncation in the shape of a horizontal plane tangent to the bottom wall of a horizontal cylinder and a base of inside diameter equal to the top inside diameter of the clamp so as to facilitate the unobstructed, non-turbulent flow of liquid to the discharge port from all directions. The preferred spout also has a height not less than ¼ and not more than ¾ of its base inside diameter so as to permit the discharge port to be comfortably received between the lips of the user without diminishing the desired flow characteristics.

Most preferably, the clamp has a circular rim with inner and outer edges and a bottom face adapted to be seated on a rim of the cup. An inner inverted frustoconical lip extends downwardly from the inner edge and an outer frustoconical lip extends downwardly from the outer edge of the clamp rim. The inner lip has serrations and the outer lip has nodules on its inner wall. The serrations and nodules cooperate so that the lips of the clamp grip the lip of the cup firmly therebetween. Preferably, the nodules are aligned between the serrations. For added strength and rigidity, approximately radial vertical walls extend upwardly from the horizontal portion of the truncation to the cylindrical portion of the truncation. An opening may also be provided in the horizontal portion of the truncation to permit insertion of a straw through the spout into the cup. It is preferred that the lid be integrally formed of plastic of thickness from 10 to 25 mils and most preferably 15 mils.

BRIEF DESCRIPTION OF THE DRAWINGS

Other objects and advantages of the invention will become apparent upon reading the following detailed description and upon reference to the drawings in which.

Figure 1:
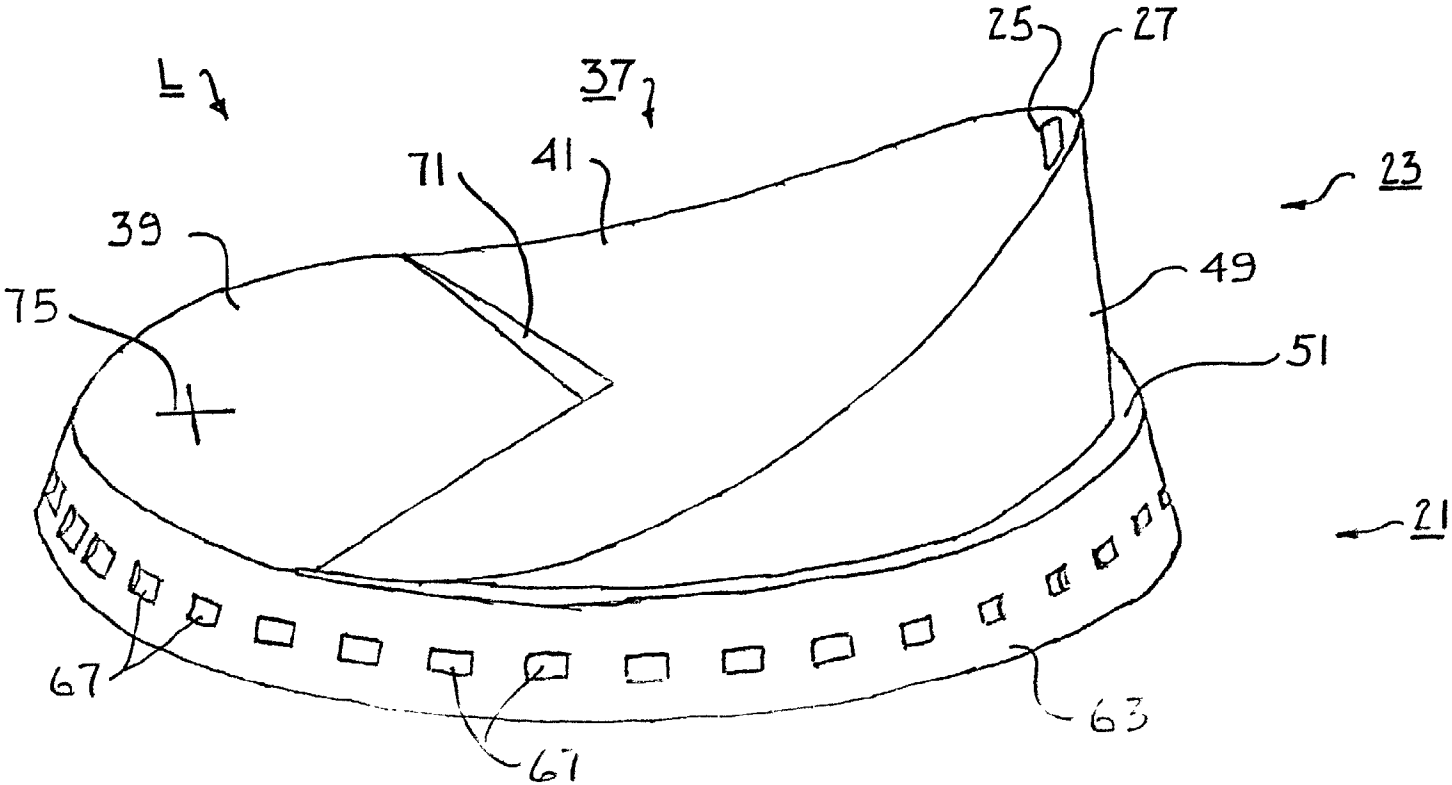
FIG. 1 is a side perspective view of a preferred embodiment of the disposable lid.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Turning to the Figures, a preferred embodiment of the disposable lid for cup is illustrated. As shown, a typical cup C to be covered has outer sidewalls 11 and inner sidewalls 13 which extend downwardly from the rim 15 at the lip 17 of the cup C to the bottom 19 of the cup C. Typically, the cup C has an inverted frustoconical shape as shown.

The disposable lid L for the cup C consists of an annular clamp 21 from which upwardly extends a spout 23 to a liquid discharge port 25 at the apex 27 of the spout 23. As shown, the inner wall 31 of the clamp 21 meets the inner wall 33 of the spout 25 at a smooth point of convergence 35 so that liquid can flow from the cup across the inner wall 31 of the clamp 21 and the inner wall 33 of the spout 23 in a pattern of unobstructed and nonturbulent flow. The upper surface of the spout 23 is defined by a truncation 37 consisting of a horizontal plane 39 which extends tangentially to the bottom wall of a horizontal cylinder 41. The inside base diameter 43 of the spout 23 is equal to the inside diameter 45 at the top of the clamp 21, these diameters being coincident with the point of smooth conveyance 35 previously discussed. The height 47 of the spout 23 from its base diameter 43 to its apex 27 is empirically appropriately not less than ¼ nor more than ¾ the inside diameter 43 of the base of the spout 23. In this configuration, the smooth junction of the clamp 21 and the spout 23, the cylindrical portion 41 of the truncation 47 and the frustoconical wall 49 of the spout 23 all combine to provide the desired unobstructed and nonturbulent flow of liquid from the cup C to the discharge port 25 of the lid L.

Figure 2:
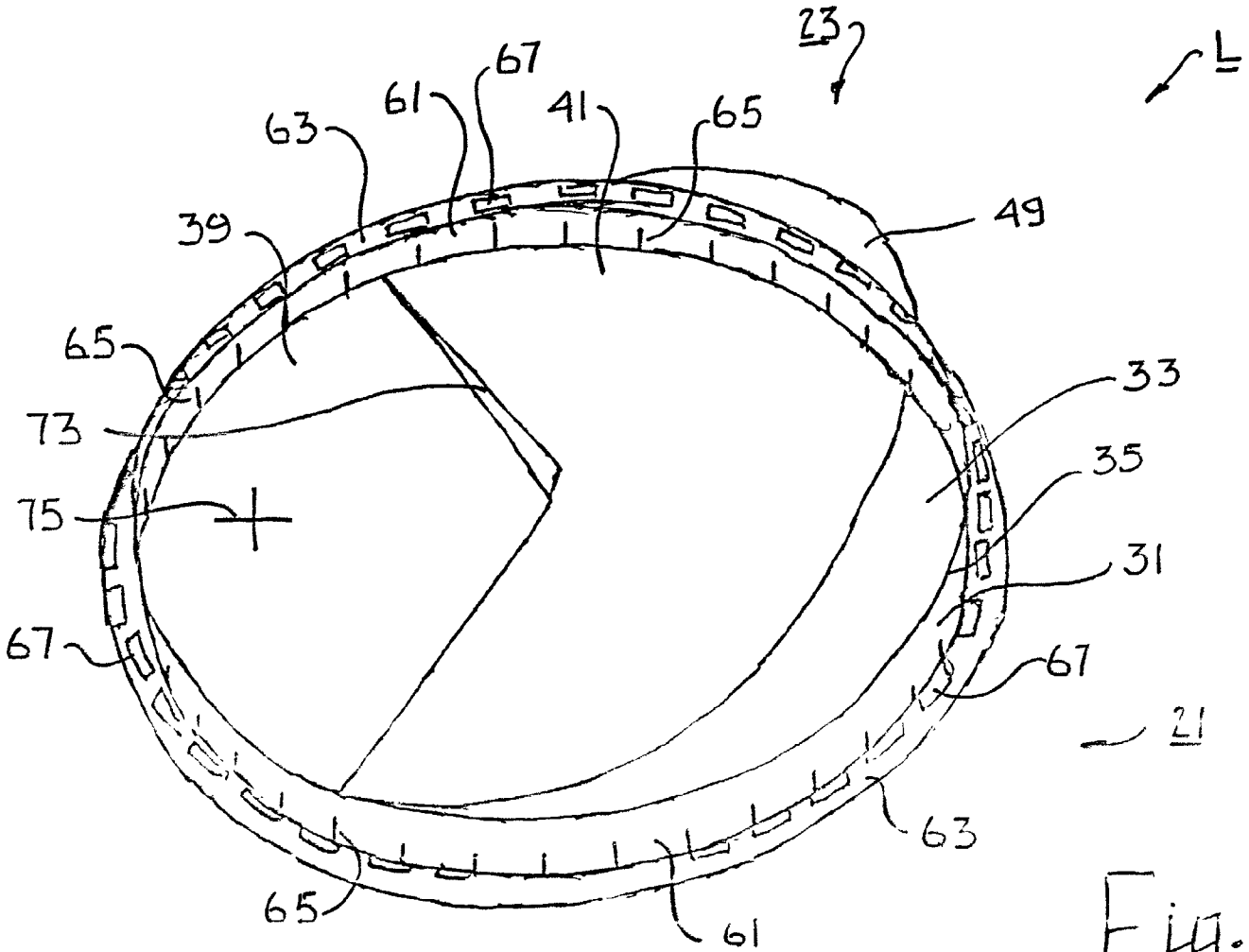
FIG. 2 is a bottom perspective view of the lid of FIG. 1.
Figure 3:
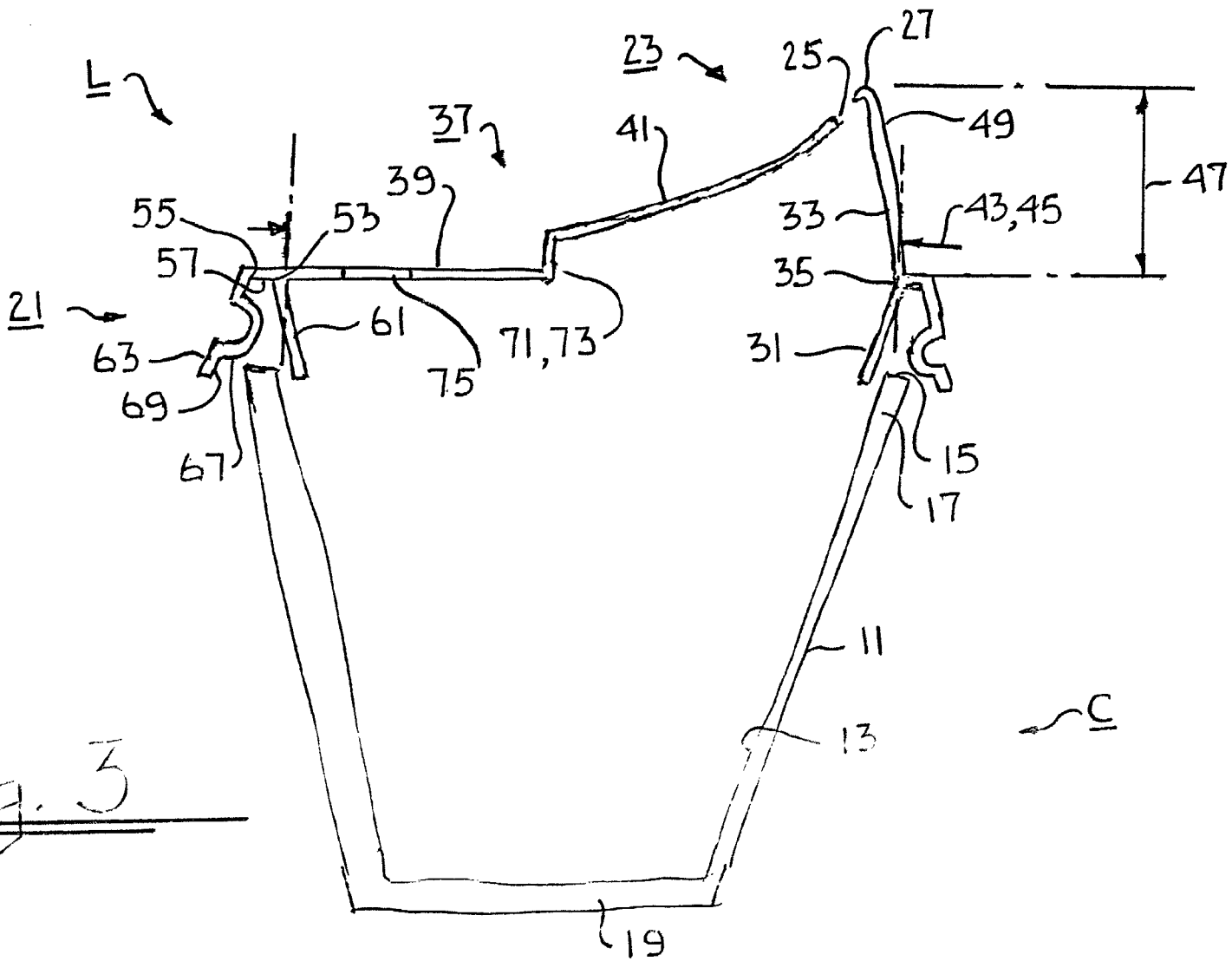
FIG. 3 is a diametric cross-sectional view taken through the center of the discharge port of the lid of FIG. 1.

Considering the clamp 21 in greater detail, it consists of a circular rim 51 having an inner edge 53, an outer edge 55 and a bottom face 57. An inverted frustoconical lip 61 extends downwardly from the inner edge 53 and an outer frustoconical lip 63 extends downwardly from the outer edge 55 so that the inner and outer sidewalls 11 and 13 of the lip 17 of the cup C can be inserted between the clamp lips 61 and 63 until the rim 15 of the cup C strikes the bottom face 57 of the clamp 21. As can best be seen in FIG. 2, the inner lip 61 has serrations 65 which cooperates with nodules 67 on the inner wall 69 of the outer lip 63 of the clamp 21 to firmly grip the lip 67 of the cup C therebetween. Thus, the disposable lid L can be firmly seated on the rim 15 of the cup C while the lips 61 and 63 of the clamp 21 firmly grip against the inner and outer walls 11 and 13 of the cup C to firmly secure the lid L to the cup C even if the walls 11 of the cup C should be moderately distorted by the grip of the user.

In order to reinforce or strengthen the lid L, approximately radial vertical walls 71 and 73 may be used to connect the horizontal plane 39 of the lid L to the cylindrical portion 41 of the lid L. As shown, the walls 71 and 73 extend at approximately a 120 degree angle away from the apex 27 of the spout 23. An opening 75 may also be provided in the horizontal plane 39 of the lid L to facilitate insertion of a straw into the cup C and to provide an air passage to prevent creation of a vacuum in the cup C during use with the lid L.

The liquid discharge port 25 at the apex 27 of the spout 23 is an elongated rectangle or elliptical opening to facilitate insertion of the discharge port 25 between the lips of the user. In addition, the curvature of the truncation 37, in cooperation with the height 47 of the spout 23 in relation to its diameter 43, allows the user to drink from the lid L in relative comfort without distortion of the position of the mouth or excessive tilting of the cup C as would be required if the truncation 37 were to strike the nose of the user during use.

Thus, it is apparent that there has been provided, in accordance with the invention, a disposable lid for a cup that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A disposable lid for a cup comprising an annular clamp adapted to be seated on a rim of the cup, said clamp having inner and outer lips to grip inner and outer walls of a lip of the cup inserted therebetween and a frustoconical spout extending upwardly from said rim to a discharge port at an apex thereof, said spout having a truncation in the shape of a horizontal plane tangent to a bottom wall of a horizontal cylinder and a base inside diameter equal to a top inside diameter of said clamp wherein an inner wall of said clamp and an inner wall of said spout converge smoothly to said discharge port.

2. A lid according to claim 1, said clamp comprising an annular rim having inner and outer edges and a bottom face adapted to be seated on a rim of the cup, an inner lip extending downwardly from said inner edge and an outer lip extending downwardly from said outer edge of said annular rim, said inner and outer lips being cooperable to grip a lip of the cup inserted therebetween.

3. A disposable lid for a cup comprising a circular rim having inner and outer edges and a bottom face adapted to be seated on a rim of the cup, an inner inverted frustoconical lip extending downwardly from said inner edge and an outer frustoconical lip extending downwardly from said outer edge, said inner lip having serrations therein and said outer lip having nodules on an inner wall thereof, said inner and said outer lips being cooperable to grip a lip of the cup inserted therebetween, and a frustoconical spout extending upwardly from said lid rim to a discharge port at an apex thereof, said spout having a truncation in the shape of a horizontal plane tangent to a bottom wall of a horizontal cylinder and a base inside diameter equal to a top inside diameter of said inner lip wherein an inner wall of said inner lip and an inner wall of said spout converge smoothly to said discharge port.

4. A lid according to claim 3, said spout having approximately radial vertical walls extending upwardly from a horizontal portion of said truncation to a cylindrical portion of said truncation.

5. A lid according to claim 3 further comprising means in a horizontal portion of said truncation for permitting insertion of a straw through said spout into the cup.

6. A lid according to claim 3, said nodules being aligned between said serrations.

7. A lid according to claim 3, said discharge port being approximately rectangular.

8. A lid according to claim 3, said spout having a height not less than ¼ and not more than ¾ of said base inside diameter.

9. A lid according to claim 3 being integrally formed of plastic and having a thickness of approximately 15 mils.

* * * * *